United States Patent [19]

Tsuchiya et al.

[11] 4,357,498

[45] Nov. 2, 1982

[54] COAXIAL TYPE MULTI-WAY PLANAR DIAPHRAGM LOUDSPEAKER SYSTEM

[75] Inventors: Yukio Tsuchiya; Kunihiko Shimada, both of Tokorozawa, Japan

[73] Assignee: Pioneer Electronic Corporation, Tokyo, Japan

[21] Appl. No.: 164,405

[22] Filed: Jun. 30, 1980

[30] Foreign Application Priority Data

Jun. 30, 1979 [JP] Japan ..... 54-82952
Jun. 30, 1979 [JP] Japan ..... 54-82953
Jun. 30, 1979 [JP] Japan ..... 54-82954

[51] Int. Cl.[3] ..... H04R 9/02; H04R 9/06; H04R 7/06

[52] U.S. Cl. ..... 179/115.5 DV; 179/115.5 PS; 179/116; 181/165

[58] Field of Search ..... 179/115.5 R, 115.5 DV, 179/115.5 PV, 115.5 PS, 115.5 VC, 116, 117, 119 R, 120, 181 R, 181 F; 181/157, 163, 164, 165, 167–174

[56] References Cited

U.S. PATENT DOCUMENTS 2,107,757 2/1938 Kinsley ..... 179/116
3,158,697 11/1964 Gorike ..... 179/116
3,873,784 3/1975 Doschek ..... 179/115.5 PV
3,937,905 2/1976 Manger ..... 179/115.5 R
3,979,566 9/1976 Willy ..... 179/115.5 VC
4,013,846 3/1977 Krawczak et al. ..... 179/115.5 R

FOREIGN PATENT DOCUMENTS 44-25734 10/1969 Japan ..... 179/115.5 DV

*Primary Examiner*—George G. Stellar
*Attorney, Agent, or Firm*—Sughrue, Mion, Zinn, Macpeak & Seas

[57] ABSTRACT

A coaxial type planar diaphragm loudspeaker system in which a plurality of coaxially arranged polygonal diaphragms are provided with separate magnetic circuits. Each magnetic circuit includes two parallel plate along each side of the diaphragm with a voice coil bobbin having the same shape as the corresponding polygonal diaphragm coupled thereto with a voice coil attached to the opposite end and disposed in the gap formed in the magnetic circuit. The area of the diaphragm falling within the juncture line between the voice coil bobbin and diaphragm is made equal to the area of the diaphragm outside the juncture line so as to eliminate split vibration.

5 Claims, 10 Drawing Figures

COAXIAL TYPE MULTI-WAY PLANAR DIAPHRAGM LOUDSPEAKER SYSTEM

BACKGROUND OF THE INVENTION

The present invention relates to planar diaphragm loudspeaker systems. More particularly, the invention relates to a coaxial type planar diaphragm loudspeaker system in which polygonal diaphragms are coaxially arranged.

It is known that a planar diaphragm has a relatively flat acoustic pressure characteristic throughout its frequency range thus providing high fidelity sound reproduction. Accordingly, loudspeaker systems employing planar diaphragms have been proposed in the art. One of the advantages of such a planar diaphragm loudspeaker system is that its acoustic image has very little shift. If a speaker system employs coaxial planar diaphragms, then the amount of shift of the acoustic image is further reduced.

In the construction of a coaxial planar diaphragm type loudspeaker system, a number of problems are involved with the configuration and assembly of various components such as the voice coil bobbin, voice coil, and magnetic circuit members. For example, for polygonal diaphragms, it is desired that the voice coil bobbin have the same configuration as the polygonal diaphragm in order to properly apply driving forces to the diaphragm. More specifically, for three planar diaphragms each having a circuit configuration with the three diaphragms coaxially arranged to form a 3-way loudspeaker system, it is necessary to provide driver units for the mid-range and treble-range inside a driver unit for the bass-range. Thus, the driver unit for the bass-range must be large in diameter to receive the remaining two driver units. This lowers the manufacturing efficiency of such a speaker system. One solution for this problem is to connect a number of small-diameter voice coils in parallel. However, that arrangement is disadvantageous in that the fabrication thereof is extremely complicated and that the back pressure in the speaker system is weakened due to a gap formed in the back surface of the diaphragms.

Another problem in constructing coaxial type loudspeaker systems is that the driving force cannot be uniformly applied to the entire surface of the planar diaphragm since the voice coil bobbin which transmits the driving force to the diaphragm cannot be attached to the diaphragm throughout the entire surface thereof. Accordingly, the driving force is concentrated in particular portions of the diaphragm. Furthermore, the voice coil bobbin must be provided in the vicinity of the outer circumferential edge of the diaphragm because of structual limitations. As a result, the mode of vibration is different between the region near the outer periphery of the diaphragm and the region near the inner periphery of the diaphragm and thus split vibration is liable to occur.

Still another problem in constructing coaxial type loudspeaker systems is that it is difficult to coaxially arrange the magnetic circuits if more than two external magnetic circuits are used in a single loudspeaker system. Normally, an external magnetic circuit is employed for the bass-range diaphragm and an internal magnetic circuit is employed for the treble-range diaphragm. It is for this reason that the external magnetic circuit is relatively large and hence it is difficult to arrange a second external magnetic circuit inside the first external magnetic circuit.

SUMMARY OF THE INVENTION

Accordingly, a primary object of the present invention is to provide a coaxial type planar diaphragm loudspeaker system in which elongated voice coil bobbin frames are provided parallel to the sides of the polygonal diaphragm.

Another object of the invention is to provide a coaxial type planar diaphragm loudspeaker system in which split vibration is prevented.

Still another object of the invention is to provide a coaxial type planar diaphragm loudspeaker system in which more than two external magnetic circuits are provided.

In accordance with these and other objects of the invention, there is provided a coaxial type planar diaphragm loudspeaker system including a plurality of coaxially arranged polygonal diaphragms, a magnetic circuit for each of the diaphragms including a voice coil bobbin coupled at one end thereof to a corresponding one of the diaphragms, a voice coil coupled to the other end of the voice coil bobbin and at least one magnet. The magnetic circuit forms a gap in which a magnetic field is imposed with the voice coil being operatively disposed in the gap. The voice coil bobbin is constructed of a plurality of elongated voice coil bobbin frames equal in number to the number of sides of one of the polygonal diaphragms. Each of the frames is arranged parallel to one of the sides of the polygonal diaphragms to form a polygonal configuration similar to that of the polygonal diaphragm. In one embodiment of the invention, the magnetic circuit includes two parallel plates disposed opposite to one another with the magnet constituted by plural thin magnets disposed along an upper edge on the inner walls of the two plates and with a yoke member joining the two plates along a lower edge thereof. In another embodiment, the yoke itself is magnetized to provide the magnetic field in the gap between the plates. In accordance with another aspect of the invention, the area or mass of the diaphragm within the voice coil bobbin, that is, the area of the diaphragm within a juncture line between the voice coil bobbin and diaphragm, is made equal to the area or mass of the diaphragm outside the juncture line. By doing so, split vibration is prevented.

DESCRIPTION OF THE PREFERRED EMBODIMENTS

The present invention will be described in detail with reference to the accompanying drawings.

Figure 1:
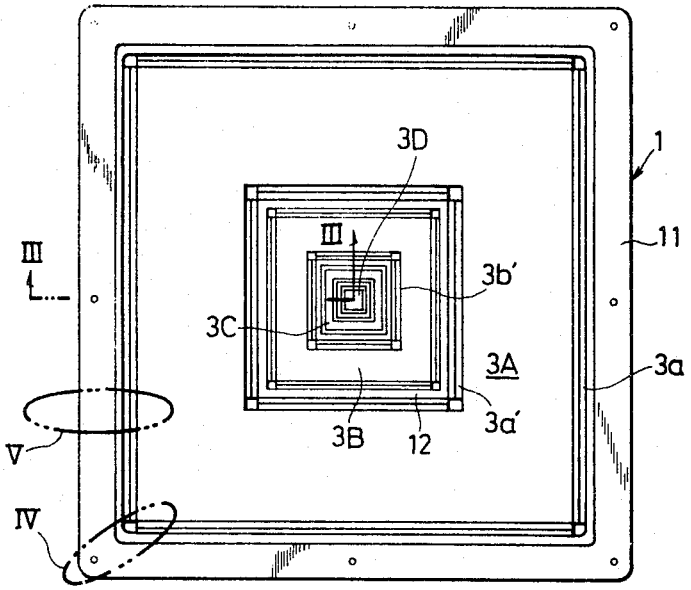
FIG. 1 is a front view illustrating a coaxial 4-way planar diaphragm loudspeaker system constructed according to the present invention.
Figure 2:
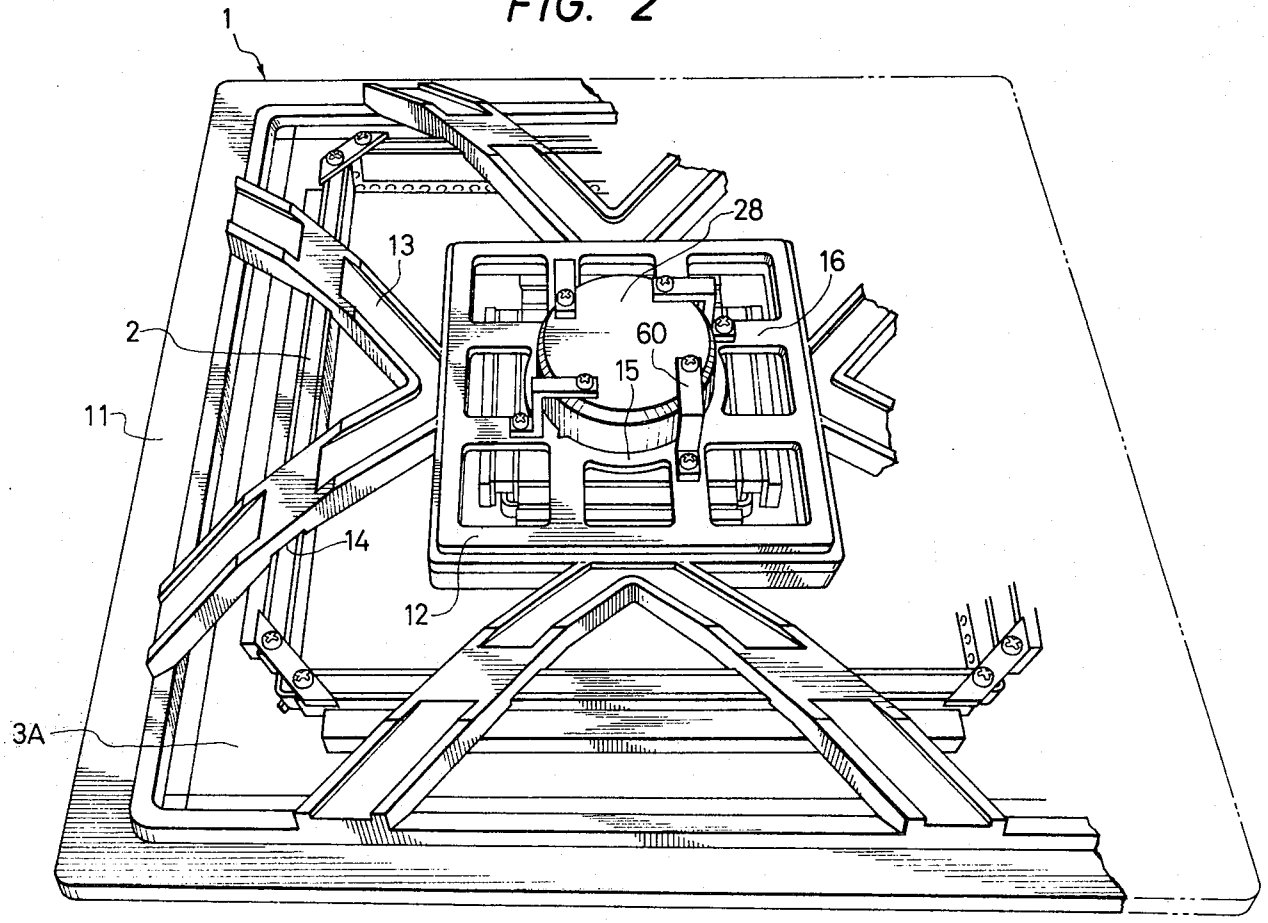
FIG. 2 is a schematic perspective view illustrating the backside of the loudspeaker system shown in FIG. 1.
Figure 3:
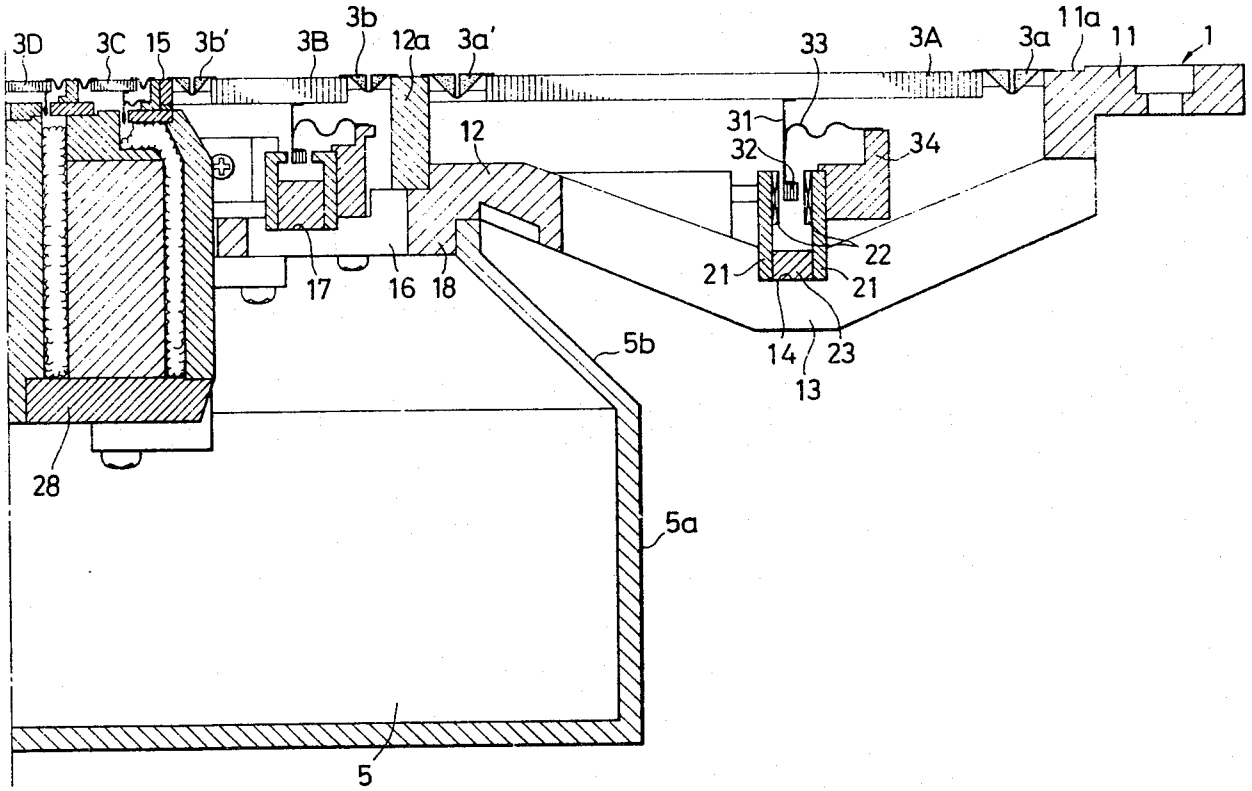
FIG. 3 is a cross-sectional view taken alone lines III—III, of the loudspeaker system shown in FIG. 1.

FIGS. 1, 2 and 3 are, respectively, a front view of a coaxial 4-way planar diaphragm loudspeaker system according to the invention, a schematic backside view and a cross-sectional view of the loudspeaker system shown in FIG. 1 cut along the line III—III. In these Figures, reference numeral 3A designates a square-shaped bass-range planar diaphragm. In the center aperture of the square-shaped bass-range planar diaphragm 3A, a mid-range planar diaphragm 3B, a treble-range planar diaphragm 3C and a super-treble-range planar diaphragm 3D are coaxially arranged in the stated order. An outer peripheral edge portion 3A of the bass-range planar diaphragm 3A is supported by a shoulder portion 11*a* of an outermost frame 11 whereas an inner peripheral edge portion 3*a*′ is supported by an edge supporter 12*a* which is attached to an inner circumferential frame 12 of a frame assembly 1 in such a manner that a front surface of the edge supporter 12*a* lies in the same plane as the front surface of the shoulder portion 11*a*. Provided axially inside is a center frame 15 which is connected to the inner circumferential frame 12 by eight connectors 16. In addition, the inner circumferential frame 12 is provided with a circular protrusion 18 to which a backchamber 5 (omitted for reasons of illustration in FIG. 2) is coupled. The outermost frame 11 and the inner circumferential frame 12 are rigidly connected by V-shaped bridges 13.

The backchamber 5 has a surface 5*b* inclined toward the inner circumferential frame 12 for the purpose of reducing the cross-sectional area with respect to the bass-range planar diaphragm 3A so that a side wall 5*a* of the backchamber 5 does not adversely affect the acoustic pressure caused by the reciprocating movement of the bass-range planar diaphragm 3A, and further so that the backside opening area of the bass-range planar diaphragm 3A is not reduced by the provision of the backchamber 5 which is otherwise designed so as to have as large as possible an inner capacity.

Figure 7A:
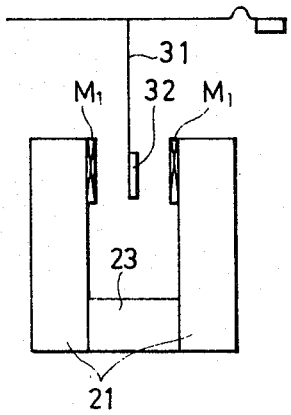
FIGS. 7A and 7B are cross-sectional views illustrating external and internal type magnetic circuits, respectively, employed with the present invention.
Figure 7B:
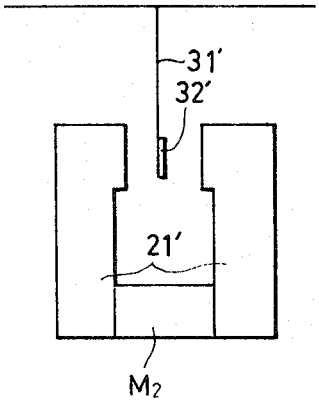

The bass-range and the mid-range diaphragms 3A and 3B are operated with external type magnetic circuits as shown in FIG. 7A while the treble-range and super-treble-range diaphragms 3C and 3D have internal type magnetic circuits as shown in FIG. 7B. In the external type magnetic circuit, plural magnets $M_1$ are secured to the inner surface of the plates 21. The magnets are provided at one end of the plates 21 while the yoke 23 is provided between the other end portions of the plates 21. The voice coil 32 is positioned in the air gap between the magnets $M_1$. On the other hand, in the internal type magnetic circuit of FIG. 7B, a single magnet $M_2$ is provided between the plates 21′ and the voice coil 32′ and the voice coil bobbin 31′ is positioned in the air gap between the plates 21′.

Figure 4:
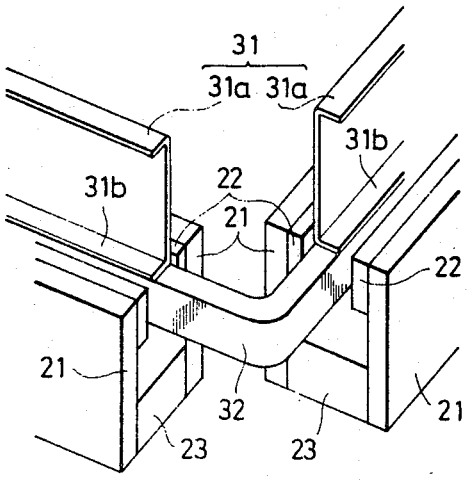
FIG. 4 is a perspective view illustrating a portion designated by IV in FIG. 1.
Figure 5:
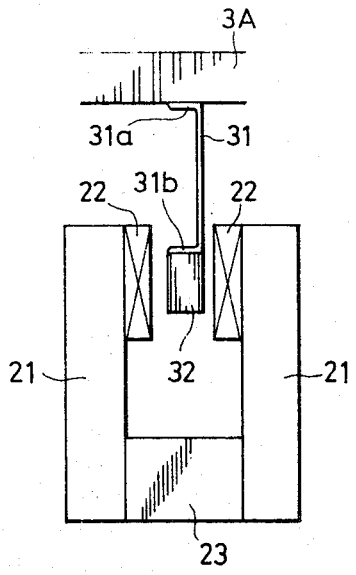
FIG. 5 is a cross-sectional view showing a portion designated by V in FIG. 1.

Details of the magnetic circuit for the bass-range diaphragm are shown in FIGS. 4 and 5. FIG. 4 is an enlarged perspective view showing a portion designated by IV in FIG. 1. FIG. 5 is an enlarged cross-sectional view showing a portion designated by V in FIG. 1. The magnetic circuit is made up of a pair of plates 21, a magnet 22 and a yoke 23. The magnetic circuit constitutes a driver unit together with a voice coil bobbin 31, a voice coil 32, a damper 33 and a damper stand 34 (see FIG. 3). The plates 21 are arranged parallel to each other with the air gap formed therebetween. Magnets, preferably rare earth type magnets, of opposite polarity are secured to the inner walls of the respective plates confronting each other. The magnets are relatively thin. One end of each of the plates 21 is coupled to the yoke 23.

The voice coil bobbin 31 is made up of four elongated bobbin frame members. Each bobbin frame is bent at right angles at both ends 31*a* and 31*b* thereof. One end 31*a* of the bobbin frame member is attached to the diaphragm while the other end 31*b* thereof has a voice coil 32 attached thereto. The four bobbin frame members are attached to the diaphragm parallel to the respective sides of the square-shaped diaphragm. That is, the four bobbin frame members substantially form a square. The cross-sectional configuration of the voice coil 32 is also square.

Figure 6A:
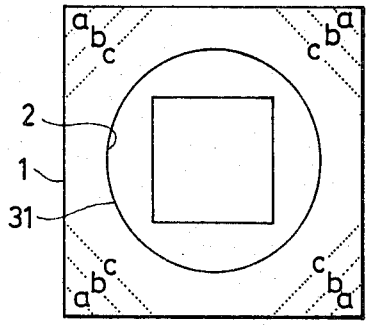
FIG. 6A PRIOR ART
FIGS. 6A and 6B are rear views illustrating the positional relationship of a voice coil bobbin with respect to a square-shaped diaphragm according to the prior art and FIG. 6C is a rear view showing the positional relationship of the voice coil bobbin with respect to the diaphragm according to the present invention.
Figure 6B:
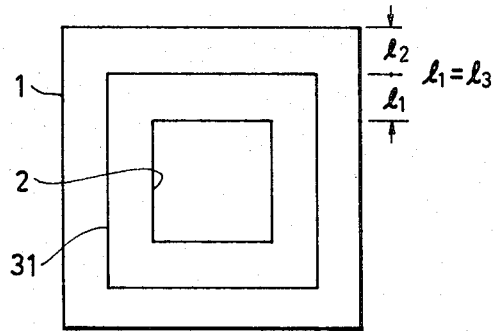
FIG. 6B PRIOR ART
Figure 6C:
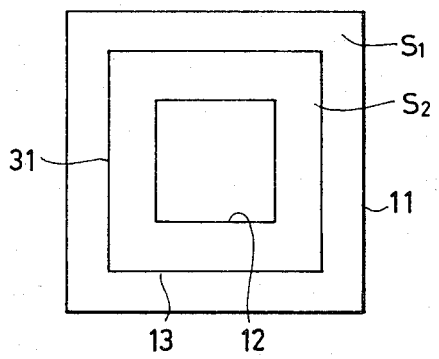

The positional relationship of the voice coil bobbin with respect to the planar diaphragm will be described with reference to FIG. 6C taken in conjunction with FIGS. 6A and 6B showing prior art techniques for attaching a voice coil bobbin to a diaphragm. If the voice coil bobbin is fixedly attached to the square-shaped planar diaphragm in a circular fashion around a square opening as shown in FIG. 6A, it has been found that split vibrations are liable to occur. It has further been found that the amount of split vibration increases in the regions of a, b and c as indicated in FIG. 6A in that order. In order to avoid the occurrence of split vibration, a diaphragm has heretofore been employed in which the corners of the diaphragm are cut to an arcuate configuration. It has also been proposed that the voice coil bobbin be supported substantially at the center between the outer and inner edges of the diaphragm as shown in FIG. 6B. In this structure, since the outer area of the diaphragm divided by the voice coil bobbin is larger than the inner area thereof, the weight of the outer portion of the diaphragm is higher than that of the inner portion. As a result, low frequency vibrations tend to occur in the outer portion of the diaphragm whereas the inner portion of the diaphragm tends not to vibrate if the applied frequency is low. For this reason, split vibration cannot be prevented with the configuration.

In view of the above-described drawbacks accompanying the prior art structures, a structure has been developed according to the present invention in which the occurrence of split vibration is prevented. Referring to FIG. 6C, the voice coil bobbin 31 is provided with a square shape similar to that shown in FIG. 6B. However, it is different therefrom in that the area $S_1$ of the outer portion of the diaphragm is made equal to the area $S_2$ of the inner portion of the diaphragm. Assuming that the diaphragm has a uniform thickness and density over the entire surface thereof, the weight of the outer portion of the diaphragm is equal to that of the inner portion thereof. By the attachment of the voice coil bobbin in the manner described, according to the invention, the frequency at which split vibration could occur is shifted to a high value so that separate vibrating and non-vibrating portions do not coexist on the surface of the diaphragm. That is, the diaphragm can vibrate uniformly over a wide range of frequencies.

Although the present invention has been described with reference to a coaxially arranged square-shaped diaphragm, it will be apparent that other shapes of polygonal diaphragms can be arranged coaxially. In any such case, voice coil bobbin frames having sides equal in number to the number of sides of the polygonal configuration are employed to form a corresponding polygonal voice coil bobbin frame.

What is claimed is:

1. A coaxial type planar diaphragm loudspeaker system comprising:

a plurality of coaxially arranged polygonal-shaped planar diaphragms, at least one of said diaphragms being a bass range diaphragm;

a magnetic circuit for each of said diaphragms, at least one magnetic circuit being a bass range magnetic circuit and one being a treble range magnetic circuit, each magnetic circuit comprising a voice coil bobbin coupled at one end to a corresponding one of said diaphragms, a voice coil coupled to the other end of said voice coil bobbin, at least one magnet, said magnetic circuit forming a gap in which a magnetic field is imposed, said voice coil being operatively disposed in said gap, said voice coil bobbin comprising a plurality of elongated voice coil bobbin frames equal in number to the number of sides of one of said polygonal diaphragms with each of said voice coil bobbin frames being arranged parallel to one of the sides of said polygonal diaphragm to form a polygonal configuration similar to that of said polygonal diaphragm, each of said magnetic circuits forming each of said gaps in which said magnetic field is imposed having a configuration corresponding to said polygonal configuration of said corresponding plurality of voice coil bobbin frames;

said bass range magnetic circuit being disposed in an area outside an area where said treble range magnetic circuit is disposed, said area where said treble range magnetic circuit is disposed being inside said area where said bass range magnetic circuit is disposed, each of said voice coil bobbin frames contacting one of said sides of said corresponding diaphragm at an intermediate portion thereof; and a frame assembly comprising an outermost circumferential frame, an inner circumferential frame, and bridging frames interconnecting said inner and outermost frames, inner and outer sides of said bass range diaphragm being supported by said inner and outermost frames respectively, said bass range magnetic circuit being secured to and supported by said bridging frames.

2. The coaxial type planar diaphragm loudspeaker system of claim 1 wherein said magnetic circuit comprises first and second parallel plates disposed opposite one another, said magnet comprising at least first and second magnets of opposite polarity coupled to inside walls of said parallel plates along a first edge thereof and further comprising a yoke joining said plates at lower edges thereof.

3. The coaxial type planar diaphragm loudspeaker system of claim 1 wherein said magnetic circuit comprises first and second parallel plates disposed opposite one another and a yoke joining said first and second parallel plates along one edge portion thereof, said yoke being magnetized.

4. The coaxial type planar diaphragm loudspeaker system of any of claims 1–3 wherein the area of said diaphragm within a juncture line between said voice coil bobbin and said diaphragm is equal to the area of said diaphragm outside said juncture line.

5. The coaxial type planar diaphragm loudspeaker system of any of claims 1–3 wherein the mass of said diaphragm within a juncture line between said voice coil bobbin and said diaphragm is equal to the mass of said diaphragm outside said juncture line.

* * * * *